US009851063B2

(12) United States Patent
Sakashita et al.

(10) Patent No.: US 9,851,063 B2
(45) Date of Patent: Dec. 26, 2017

(54) VEHICLE LAMP

(71) Applicant: Koito Manufacturing Co., Ltd., Tokyo (JP)

(72) Inventors: Kazuhisa Sakashita, Shizuoka (JP); Yuichi Yamamoto, Shizuoka (JP); Shingo Kato, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 17 days.

(21) Appl. No.: 14/748,746

(22) Filed: Jun. 24, 2015

(65) Prior Publication Data

US 2016/0003437 A1 Jan. 7, 2016

(30) Foreign Application Priority Data

Jul. 1, 2014 (JP) ..... 2014-135840

(51) Int. Cl.
*B60Q 1/04* (2006.01)
*F21S 8/10* (2006.01)

(52) U.S. Cl.
CPC ..... *F21S 48/1159* (2013.01); *F21S 48/1266* (2013.01); *F21S 48/1323* (2013.01); (Continued)

(58) Field of Classification Search
CPC ..... F21S 48/1159; F21S 48/1266; F21S 48/1323; F21S 48/1388; F21S 48/1394; (Continued)

(56) References Cited

U.S. PATENT DOCUMENTS 7,726,859 B2 * 6/2010 Naganawa ..... F21S 48/1159 362/297
8,414,171 B2 * 4/2013 Kawamura ..... B60Q 1/2696 362/545

(Continued)

FOREIGN PATENT DOCUMENTS

CN 1601175 A 3/2005
CN 101676608 A 3/2010

(Continued)

OTHER PUBLICATIONS

An Office Action dated Apr. 5, 2017, issued from the Chinese State Intellectual Property Office of the P.R.C (SIPO) of Chinese Patent Application No. 201510358415.0 and an EN translation thereof.

*Primary Examiner* — Peggy Neils
(74) *Attorney, Agent, or Firm* — Abelman, Frayne & Schwab

(57) ABSTRACT

Disclosed is a vehicle lamp including a projection lens, and a light source located behind the projection lens so that light emitted from the light source is irradiated forward through the projection lens. The projection lens includes an upright wall surface formed on a peripheral edge thereof, in which the upright wall surface has a greater longitudinal inclination angle than a front surface of the projection lens. A light control member is located behind the projection lens, in which the light control member is configured to suppress light incident on the projection lens from the light source, from being internally reflected by the upright wall surface.

20 Claims, 6 Drawing Sheets

(52) U.S. Cl.
CPC ..... *F21S 48/1388* (2013.01); *F21S 48/1394* (2013.01); *F21S 48/145* (2013.01); *F21S 48/328* (2013.01)

(58) Field of Classification Search
CPC ..... F21S 48/145; F21S 48/328; F21S 48/125; F21S 48/13; F21S 48/14; F21S 48/32
See application file for complete search history.

(56) References Cited

U.S. PATENT DOCUMENTS

| | | | | |
|---|---|---|---|---|
| 9,222,638 | B2 * | 12/2015 | Nakada | F21S 48/1317 |
| 2009/0310353 | A1 * | 12/2009 | Inaba | F21S 48/1159 362/235 |
| 2012/0243250 | A1 * | 9/2012 | Yagi | F21S 48/1154 362/520 |

FOREIGN PATENT DOCUMENTS

| | | | |
|---|---|---|---|
| CN | 102798066 | A | 11/2012 |
| JP | 2014-029830 | A | 2/2014 |

* cited by examiner

VEHICLE LAMP

CROSS-REFERENCE TO RELATED APPLICATIONS

This application is based on and claims priority from Japanese Patent Application No. 2014-135840, filed on Jul. 1, 2014, with the Japan Patent Office, the disclosure of which is incorporated herein in its entirety by reference.

TECHNICAL FIELD

The present disclosure relates to a projector type vehicle lamp.

BACKGROUND

Conventionally, there is known a projector type vehicle lamp that is configured to irradiate light from a light source located behind a projection lens forward through the projection lens.

Japanese Patent Laid-Open Publication No. 29830 discloses a configuration of a vehicle lamp, in which a peripheral edge of a projection lens is formed with an upright wall surface having a greater longitudinal inclination angle than the front surface of the projection lens.

SUMMARY

In a case where the upright wall surface is formed on the peripheral edge of the projection lens as in the vehicle lamp described in Japanese Patent Laid-Open Publication No. 2014-29830, the light internally reflected from the upright wall surface of the projection lens may be irradiated forward depending on the configuration of the lamp. This light, however, is uncontrolled stray light, thus causing light distribution unevenness.

The present disclosure has been made in consideration of such a situation and has an object to provide a projector type vehicle lamp capable of preventing generation of light distribution unevenness even in a case where an upright wall surface is formed on a peripheral edge of a projection lens.

The present disclosure is to achieve the object described above by providing a configuration including a light control member.

A vehicle lamp according to the present disclosure includes a projection lens, and a light source located behind the projection lens so that light emitted from the light source is irradiated forward through the projection lens. The projection lens includes a sidewall surface which is smoothly curved to be a substantially flat surface having a longitudinally elongated shape when viewed from a front side thereof. Moreover, the sidewall surface has a greater inclination angle with reference to a plane perpendicular to an optical axis of the projection lens than a front surface of the projection lens when viewed in a horizontal cross section. A light control member is provided on both left and right side portions of an inner circumferential surface of a lens holder supporting the projection lens to protrude closer to each other toward the optical axis behind the projection lens when viewed in a horizontal cross section such that the light reflected in a direction away from the optical axis by a reflector is shielded by the light control member, thereby suppressing light incident toward the projection lens from the light source, from being internally reflected by the sidewall surface toward the optical axis of the projection lens via total reflection.

The vehicle lamp according to the present disclosure may be configured such that the light emitted from the light source is incident on a projection lens as incident light. Alternatively, the vehicle lamp may be configured such that the light emitted from the light source is reflected by a reflector to be incident on the projection lens.

The kind of the "light source" is not specifically limited and, for example, a light emitting device such as, for example, a light emitting diode or a laser diode, or a light source bulb may be employed.

The "upright wall surface" is not particularly limited in terms of a detailed shape thereof so long as it has a greater longitudinal inclination angle than the front surface of the projection lens. In addition, the "upright wall surface" may be formed over the peripheral edge of the projection lens or on a portion of the peripheral edge of the projection lens.

The "light control member" is not particularly limited in terms of a detailed configuration and arrangement thereof so long as it is configured to prevent light incident on the projection lens from the light source from being internally reflected by the upright wall surface.

As illustrated in the above-described configuration, the vehicle lamp according to the present exemplary embodiment is configured as a projector type lamp unit, the projection lens of the vehicle lamp includes the upright wall surfaces formed on the peripheral edge and having a greater longitudinal inclination angle than the front surface of the projection lens. However, since a light control member is arranged behind the projection lens to prevent the light incident on the projection lens from the light source from being internally reflected by the upright surface, the following acting effects may be achieved.

That is, due to the existence of the light control member, the light incident on the projection lens is not internally reflected by the upright wall surfaces. Thus, it is possible to forestall the problem that the light internally reflected by the upright wall surfaces of the projection lens is irradiated as stray light, as is conventionally encountered. In this way, it is possible to forestall the problem that light distribution unevenness is generated.

According to the present disclosure as described above, in the projector type vehicle lamp, it is possible to forestall the generation of light distribution unevenness, even in a case where the upright wall surface is formed on the peripheral edge of the projection lens.

In the configuration, while the concrete shape of the upright wall surface is not specifically limited as described above, in a case where the maximum height of the upright wall surface is set to a value of ½ or more of the maximum thickness of the projection lens, the quantity of light internally reflected by the upright wall surface is considerably increased. Therefore, it is particularly effective to employ the configuration of the present disclosure.

At this time, in a case where the maximum height of the upright wall surface is set to a value of ⅔ or more of the maximum thickness of the projection lens, it is more effective to employ the configuration of the present disclosure.

In the configuration, when the light control member is configured by a lens holder that supports the projection lens, the acting effects can be acquired without an increase in the number of parts.

In the configuration, in a case where the light source is a light emitting device supported on a heat sink, the acting effects can be acquired without an increase in the number of parts when the light control member is configured by the heat sink.

In the configuration, in a case where the lamp includes a reflector that reflects light emitted from the light source to the projection lens and a shade that shields some of reflected light from the reflector, the front surface of the shade may be formed with irregularities. When this configuration is employed, it is possible to effectively suppress the reflected light, reflected from the reflector and then surface-reflected by the rear surface of the projection lens, from being reflected by the front surface of the shade to be incident again on the projection lens. Consequently, it is possible to effectively suppress the light, reflected by the front surface of the shade to be incident again on the projection lens, from being irradiated forward as stray light.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, the exemplary embodiments of the present disclosure will be described with reference to the drawings.

Figure 1:
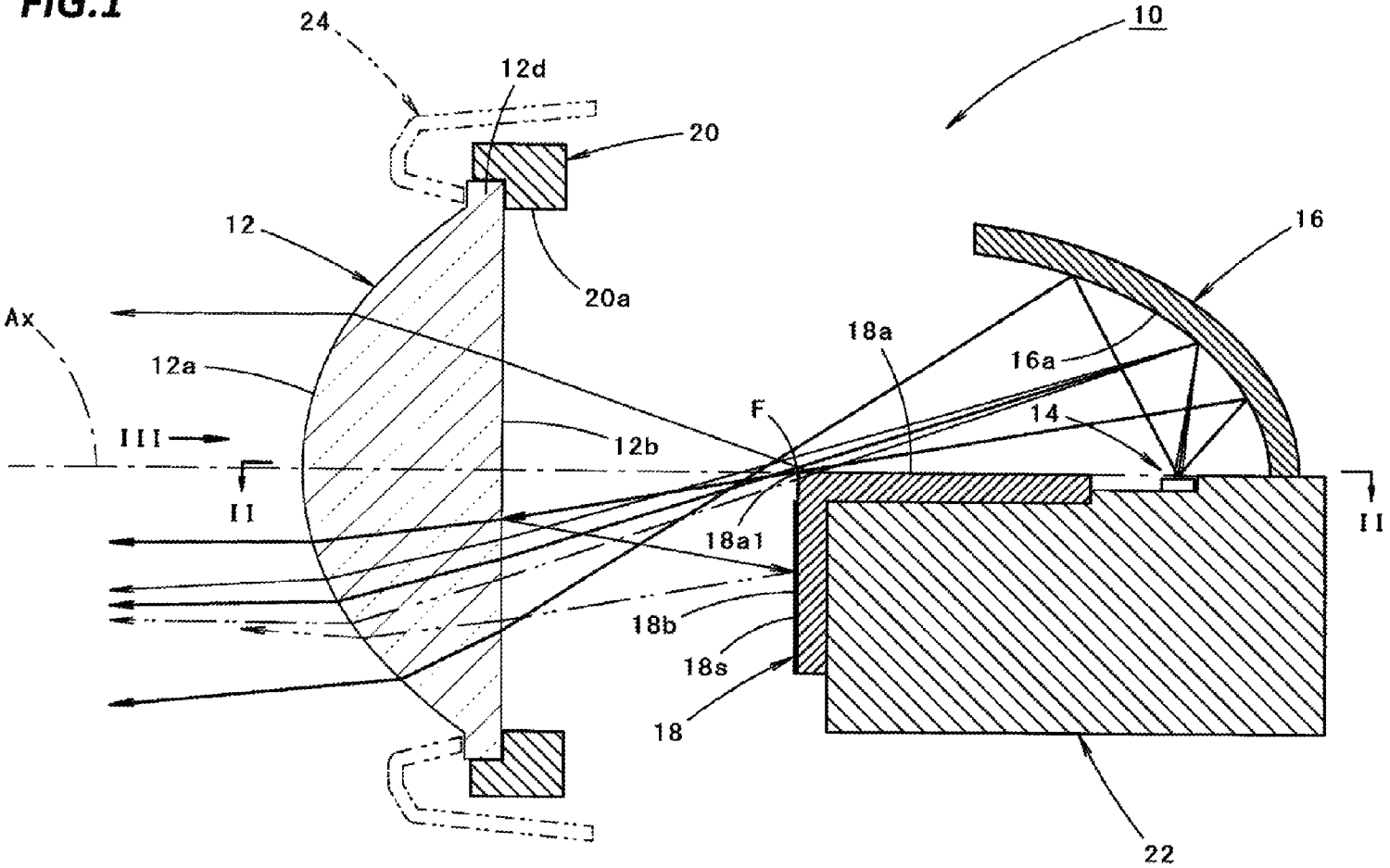
FIG. 1 is a sectional side view illustrating a vehicle lamp according to one exemplary embodiment of the present disclosure.
Figure 2:
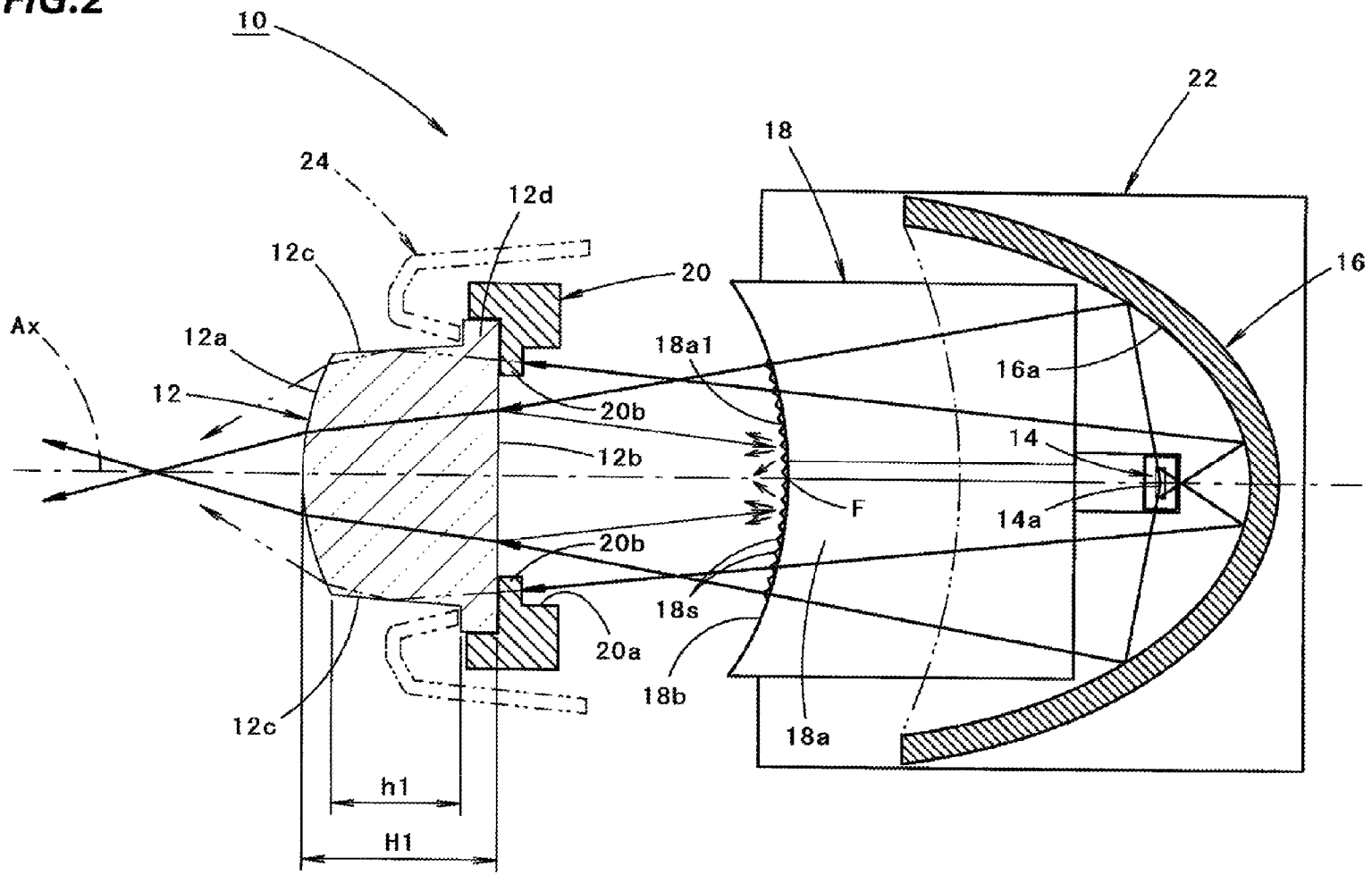
FIG. 2 is a sectional view taken along line II-II in FIG. 1.
Figure 3:
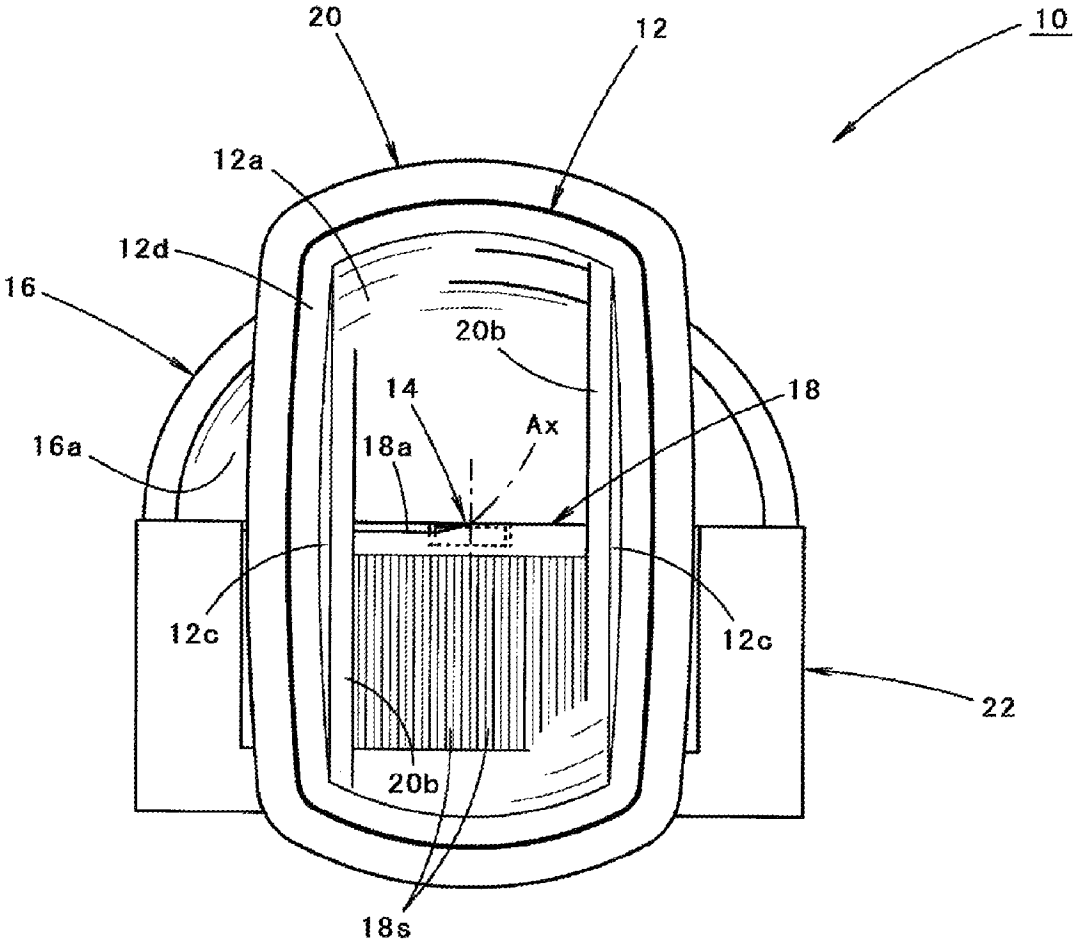
FIG. 3 is a view taken in the direction of arrow III in FIG. 1.

FIG. 1 is a side sectional view illustrating a vehicle lamp according to one exemplary embodiment of the present disclosure, FIG. 2 is a sectional view taken along line II-II in FIG. 1, and FIG. 3 is a view taken in the direction of arrow III in FIG. 1.

As illustrated in FIGS. 1 to 3, the vehicle lamp 10 according to the present exemplary embodiment is a low-beam lamp unit that is used in an inserted state as a portion of a headlamp, and is configured as a projector type lamp unit.

That is, the vehicle lamp 10 includes a projection lens 12 having an optical axis Ax extending in the longitudinal direction of a vehicle, a light emitting device 14 serving as a light source located behind a rear focal point F of the projection lens 12, a reflector 16 located to cover the light emitting device 14 from the upper side to reflect light from the light emitting device 14 toward the projection lens 12, a shade 18 configured to shield some of the light reflected from the reflector 16, a lens holder 20, and a heat sink 22.

Upon being inserted into a headlamp, the vehicle lamp 10 is located such that its optical axis Ax extends downward by about 0.5° to 0.6° in relation to the longitudinal direction of the vehicle.

The projection lens 12 is a plano-convex aspherical lens having a convex front surface 12*a* and a flat rear surface 12*b*. The projection lens 12 is configured to project a light source image, formed on a rear focal plane that is a focal plane including the rear focal point F, to a virtual vertical screen in front of the lamp as a reversed image.

The projection lens 12 includes a pair of left and right upright wall surfaces 12*c* formed on the peripheral edge thereof and has a vertically elongated outer shape when viewed from the front side of the lamp. In addition, an outer circumferential flange 12*d* is formed over the entire peripheral edge of the projection lens 12 to protrude to the outer circumferential side along the rear surface 12*b*.

Each sidewall surface 12*c* is smoothly curved to be a substantially flat surface having a longitudinally elongated shape when viewed from a front side of the projection lens, and has a greater inclination angle with reference to a plane perpendicular to an optical axis of the projection lens than the front surface 12*a* of the projection lens 12 when viewed in a horizontal cross section. At this time, the front edge (i.e. the ridgeline as the intersection line with the front surface 12*a*) of each sidewall surface 12*c* is formed to linearly extend in the vertical direction when viewed from the front side of the lamp. In addition, each surface 12*c* is formed to extend in a backward direction from the front edge by an inclination angle of 80° or more (e.g., about 85°) with reference to a plane perpendicular to the optical axis Ax. In addition, each sidewall surface 12*c* has the maximum thickness h1 in a forward and backward direction of the projection lens 12 that is set to a value of ½ or more (more specifically, ⅔ or more, e.g., about ¾) of the maximum thickness H1 of the projection lens 12 in a forward and backward direction thereof.

The projection lens 12 is supported, at the outer circumferential flange 12*d* thereof, by the lens holder 20 and the lens holder 20 is supported on, for example, the heat sink 22 via a support member (not illustrated).

The lens holder 20 has an annular shape and supports the outer circumferential surface and the rear surface of the outer circumferential flange 12*d* of the projection lens 12. The lens holder 20 includes a pair of left and right inner circumferential flanges 20*b* formed on both left and right side portions of the inner circumferential surface 20*a* thereof to protrude closer to each other. Each inner circumferential flange 20*b* is formed such that its front surface extends in the vertical direction along the rear surface 12*b* of the projection lens 12.

In addition, a panel member 24 is disposed around the projection lens 12 to cover the outer circumferential flange 12*d* of the projection lens 12 and the lens holder 20 in an annular form from the front side.

The light emitting device 14 is a white light emitting diode and has a laterally elongated rectangular light emitting surface 14*a*. In addition, the light emitting device 14 is disposed such that its light emitting surface 14*a* extends in the transverse direction to face upward on the horizontal plane including the optical axis Ax. The light emitting device 14 is supported on the heat sink 22.

A reflective surface 16*a* of the reflector 16 is formed in a curved surface of an approximately elliptical shape, a first focal point of which is the light emission center of the light emitting device 14, and the eccentricity of the reflective surface 16*a* is set to gradually increase from the vertical cross section to the horizontal cross section. In this way, the reflector 16 is configured to converge light from the light emitting device 14 to a point located slightly ahead the rear focal point F in the vertical cross section, and move the converged position greatly forwardly in the horizontal cross section. The reflector 16 is supported on the heat sink 22.

The shade 18 has an L-shape in the sectional side view and the upper surface of the shade 18 is configured as an upward reflective surface 18*a* subjected to a metal deposition processing. A left region of the upward reflective surface 18*a* located at the left side of the optical axis Ax (the right side when viewed from the front side of the lamp) is configured as a horizontal surface, and a right region of the upward reflective surface 18*a* located at the right side of the optical axis Ax is configured as a horizontal surface that is located one level lower than the left region via a short inclined surface. A front edge 18*a*1 of the upward reflective surface 18*a* is forwardly curved from the rear focal point F toward both left and right sides. The shade 18 is supported on the heat sink 22.

The upward reflective surface 18*a* of the shade 18 is configured to shield some of reflected light directed from the reflective surface 16*a* of the reflector 16 to the projection lens 12 and then reflect the light upward, so as to cause the light to be introduced into the projection lens 12 and emitted as downward light from the projection lens 12.

A plurality of irregularities 18*a* is formed, in a vertical stripe pattern, on a front surface 18*b* of a front wall extending downward from the front edge 18*a*1 of the upward reflective surface 18*a* of the shade 18. At this time, upper edges of the respective irregularities 18*s* are located slightly below the optical axis Ax. The irregularities 18*s* are configured to diffuse and reflect, in the transverse direction, some of reflected light from the reflector 16 reflected by the rear surface 12*b* of the projection lens 12 and reaching the front surface 18*b* of the shade 18, and as a result, to suppress reintroduction of the light reflected by the front surface 18*b* to the projection lens 12.

As illustrated in FIG. 2, light, emitted from the light emission center of the light emitting device 14 (i.e. the center position of the light emitting surface 14*a*) and reflected by the reflector 16, is converged near the optical axis Ax, while light, emitted from edge positions in the transverse direction of the horizontally elongated light emitting surface 14*a* and reflected from the regions of the reflective surface 16*a* of the reflector 16 close to the optical axis laterally opposite to the edge positions, is diffused in the direction away from the optical axis Ax.

At this time, assuming that the lens holder 20 is not formed with the pair of left and right inner circumferential flanges 20*b*, the light reflected in the direction away from the optical axis Ax by the reflective surface 16*a* of the reflector 16, as represented by two-dot chain line in FIG. 2, is introduced to the projection lens 12 from both side edge regions of the rear surface 12*b* of the projection lens 12. Thereafter, the light reaches the pair of left and right upright wall surfaces 12*c* and is internally reflected by via total reflection in the upright wall surfaces 12*c*. Then, the light internally reflected by the respective upright wall surfaces 12*c* is emitted, as uncontrolled stray light, forward from the front surface 12*a* of the projection lens 12 in the greatly transversely deviated direction.

However, in the present exemplary embodiment, the respective inner circumferential flanges 20*b* formed on the lens holder 20 is configured to shield the reflected light reflected from the reflector 16 to be incident on the projection lens 12 from the side edge regions of the rear surface 12*b* of the projection lens 12, thereby preventing the reflected light from reaching the respective upright wall surfaces 12*c* and thus, preventing the reflected light from being internally reflected by the upright wall surfaces 12*c*.

Figure 4:
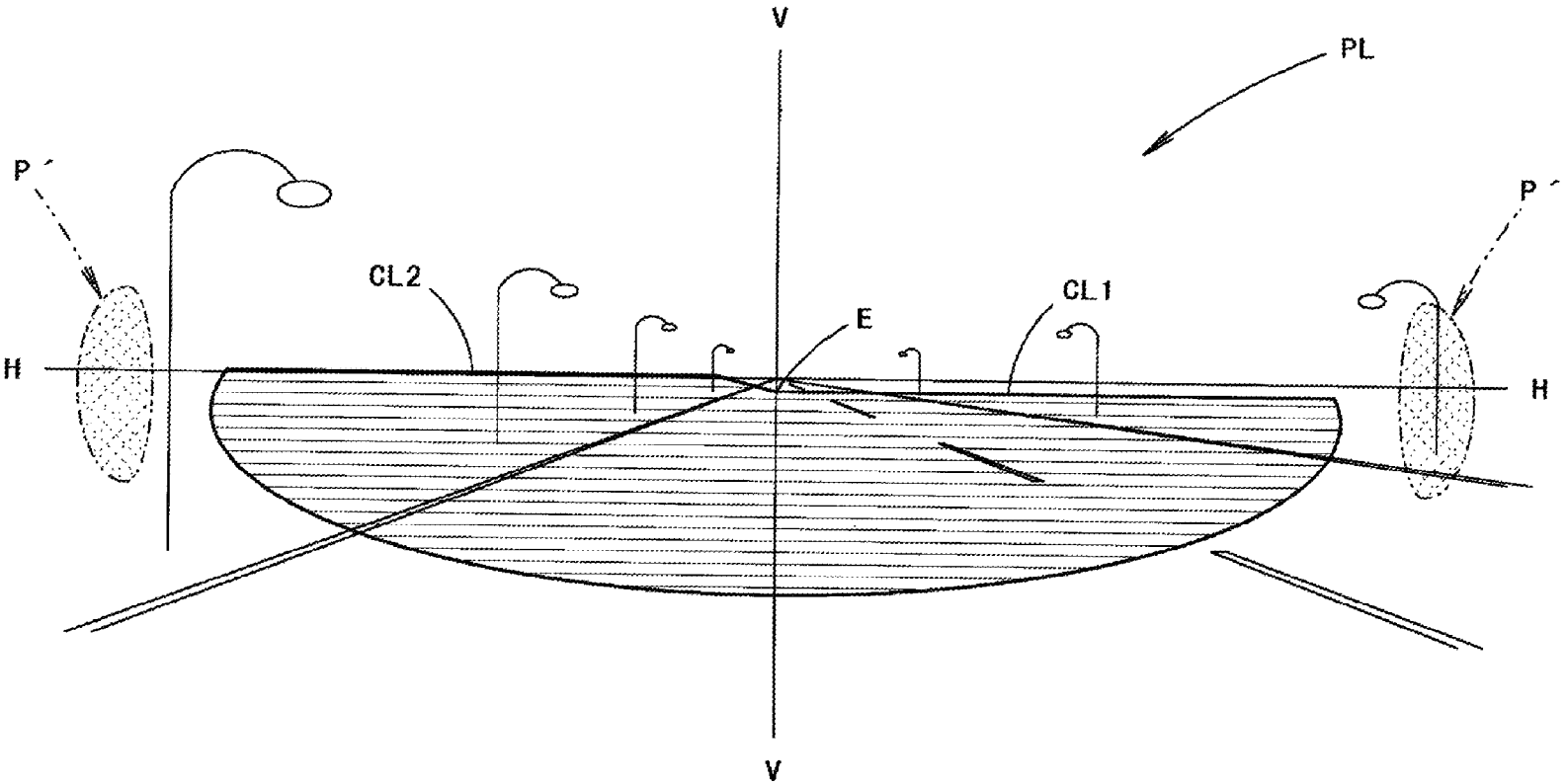
FIG. 4 is a perspective view illustrating a low-beam light distribution pattern formed on a virtual vertical screen located at a position 25 m ahead the vehicle lamp by light irradiated forward from the lamp.

FIG. 4 is a perspective view illustrating a low-beam light distribution pattern PL formed on a virtual vertical screen, located at a position 25 m ahead the vehicle, by light irradiated forward from the vehicle lamp 10.

The low-beam light distribution pattern PL is a low-beam light distribution pattern for left light distribution and has left and right unlevel cutoff lines CL1 and CL2 in the upper edge thereof. The cutoff lines CL1 and CL2 horizontally extend with a height difference at the left and right sides of a boundary line V-V vertically passing a vanishing point H-V in front of the lamp. An opposite lane side portion at the right side of the line V-V is formed as the lower level cutoff line CL1 and an own lane side portion is formed as the upper level cutoff line CL2, of which the level is raised from the lower level cutoff line CL1 via a slope.

The low-beam light distribution pattern PL is formed by projecting a light source image of the light emitting device 14, which is formed on the rear focal plane of the projection lens 12 by the light emitted from the light emitting device 14 and reflected by the reflector 16, to the virtual vertical screen by the projection lens 12 as a reversed image. The cutoff lines CL1 and CL2 of the low-beam light distribution pattern PL are adapted to be formed as a reversed projection image of the front edge 18*a*1 of the upward reflective surface 18*a* of the shade 18.

In the low-beam light distribution pattern PL, an elbow point E that is an intersection point of the lower end cutoff line CL1 and the line V-V is located below H-V by about 0.5° to 0.6°. This is caused since the optical axis Ax extends in a direction directed downward by about 0.5° to 0.6° in relation to the longitudinal direction of the vehicle.

Small light distribution patterns (i.e. light distribution patterns represented by two-dot chain lines in FIG. 4) located at the left and right sides of the low-beam light distribution pattern PL are light distribution patterns formed by the light internally reflected by the pair of left and right upright wall surfaces 12*c* of the projection lens 12 when it is assumed that the lens holder 20 is not formed with the pair of left and right inner circumferential flanges 20*b*. The two light distribution patterns P' are formed to vertically across the positions of the cutoff lines CL1 and CL2 at the left and right sides of the low-beam light distribution pattern PL.

Next, the acting effects of the present exemplary embodiment will be described.

The vehicle lamp 10 according to the present exemplary embodiment is configured as a projector type lamp unit. The projection lens 12 of the vehicle lamp 10 includes the upright wall surfaces 12 formed on the peripheral edge and having a greater longitudinal inclination angle than the front surface 12*a* of the projection lens 12. However, since the inner circumferential flanges 20*b* of the lens holder 20 are arranged behind the projection lens 12 and serve as a light control member to prevent the light, which is incident on the projection lens 12 from the light emitting device 14, from being internally reflected by the upright wall surfaces 12*c*.

That is, due to the existence of the inner circumferential flange portions 20*b* of the lens holder 20, the light incident on the projection lens 12 is not internally reflected by the upright wall surfaces 12*c*. Thus, it is possible to forestall the problem that the light internally reflected by the upright wall surfaces 12*c* of the projection lens 12 is irradiated as stray light, as is conventionally encountered. In this way, it is possible to forestall the problem that light distribution unevenness is generated in the low-beam light distribution pattern PL.

Through the present exemplary embodiment as described above, it is possible to forestall the generation of light distribution unevenness in the projector type vehicle lamp 10, even in a case where the upright wall surfaces 12*c* are formed on the peripheral edge of the projection lens 12.

At this time, in the present exemplary embodiment, the maximum height h1 of each upright wall surface 12*c* is set to a value of ½ or more of the maximum thickness H1 of the projection lens 12 and the quantity of light internally reflected by each upright wall surface 12*c* is considerably increased. Therefore, it is very effective to employ the configuration of the present exemplary embodiment.

In particular, in the present exemplary embodiment, the maximum height h1 of the upright wall surface 12*c* is set to a value of ⅔ or more of the maximum thickness H1 of the projection lens 12. Therefore, it is more effective to employ the configuration of the present exemplary embodiment.

Moreover, in the present exemplary embodiment, the light control member is configured by the lens holder 20 that supports the projection lens 12. Therefore, the acting effects may be obtained without increasing the number of parts.

In the present exemplary embodiment, the lamp includes the reflector 16 that reflects light emitted from the light emitting device 14 toward the projection lens 12 and the shade 18 that shields some of reflected light from the reflector 16. The irregularities 18*s* are formed on the front surface 18*b* of the shade 18. Therefore, the following acting effects may be achieved.

Since the irregularities 18*s* are formed on the front surface 18*b* of the shade 18, it is possible to effectively suppress the reflected light reflected from the reflector 16 and then surface-reflected by the rear surface 12*b* of the projection lens 12, from being reflected by the front surface 18*b* of the shade 18 to be incident again on the projection lens 12. Consequently, it is possible to effectively suppress the light, reflected from the front surface 18*b* of the shade 18 to be incident on the projection lens 12, from being irradiated as stray light.

In the present exemplary embodiment, from a point of view of achieving a greater amount of reflected light from the reflector 16 (i.e. light reflected in the direction near the optical axis Ax to thereby reach the projection lens 12), which contributes to formation of the low-beam light distribution pattern PL, it is preferable that the lateral protrusion of each inner circumferential flange 20*b* configuring the light control member may be reduced as much as possible within a range capable of preventing light reflected in the direction away from the optical axis Ax by the reflector 16 from reaching each upright wall surface 12*c*.

In the exemplary embodiment, although it has been described that the light control member is configured by the lens holder 20 supporting the projection lens 12, the light control member may be configured by a new separate member.

In the exemplary embodiment described above, although it has been described that the irregularities 18*s* are formed in the vertical stripe form on the front surface 18*b* of the shade 18, the same acting effects may be acquired in a case where the irregularities are formed by performing an embossing process or a frost processing on the front surface 18*b* of the shade 18.

In the exemplary embodiment, although descriptions have been made on the projector type lamp unit configured to reflect light emitted from the light emitting device 14 by the reflector 16, a projector type lamp unit configured to make light emitted from the light emitting device 14 directly incident on the projection lens 12 may be adopted.

Next, a modification of the exemplary embodiment will be described.

Figure 5:
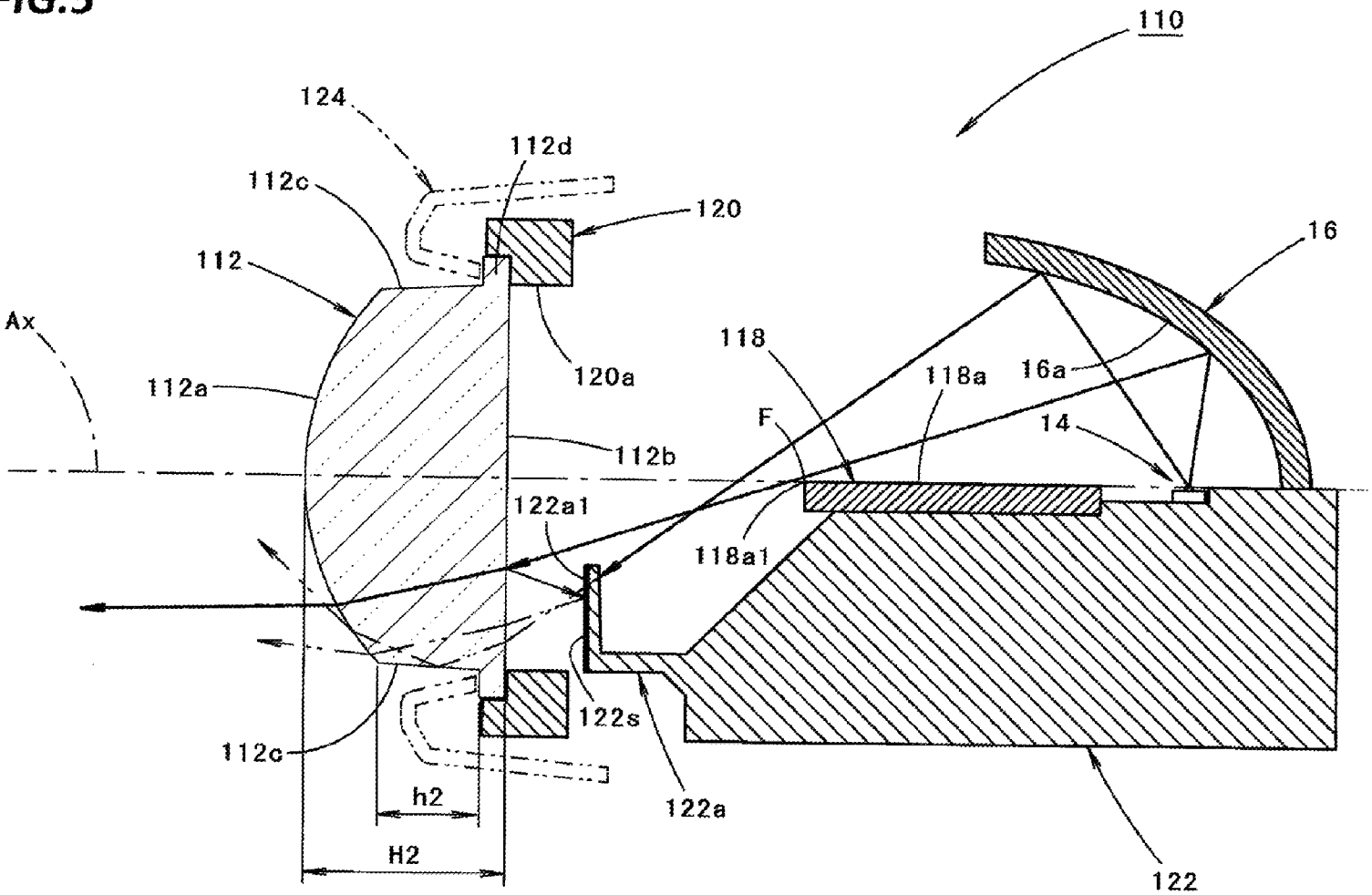
FIG. 5 is a view equal to FIG. 1 illustrating a vehicle lamp according to a modification of the exemplary embodiment.
Figure 6:
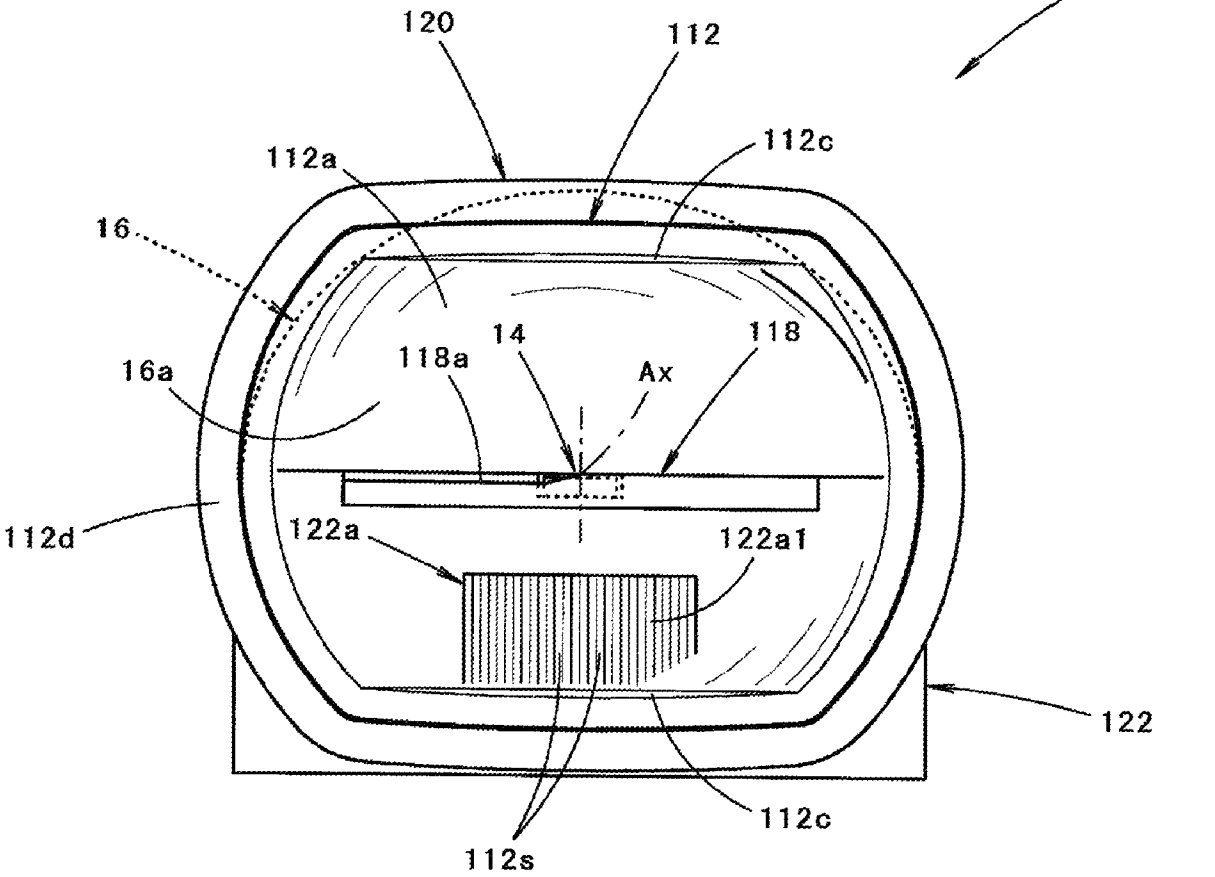
FIG. 6 is a view equal to FIG. 3 illustrating the vehicle lamp according to the modification.

FIGS. 5 and 6 are views corresponding to FIGS. 1 and 3 illustrating a vehicle lamp 110 according to a modification.

As illustrated in FIGS. 5 and 6, the vehicle lamp 110 is configured as a projector type lamp unit to reflect light from the light emitting device 14 by the reflector 16, like the vehicle lamp 10 of the exemplary embodiment. However, the configurations other than the light emitting device 14 and the reflector 16 are different from those in the exemplary embodiment.

That is, although a projection lens 112 of the present modification is configured as a plano-convex aspherical lens having a convex front surface 112*a* and a flat rear surface 112*b*, a pair of upper and lower upright wall surfaces 112*c* is formed on the peripheral edge of the projection lens 112 and has a laterally elongated external shape when viewed from the front side of the lamp. In addition, an outer circumferential flange 112*d* is formed over the entire peripheral edge of the projection lens 112 to protrude to the outer circumferential side along the rear surface 112*b*.

Each upright wall surface 112*c* is configured as a curved surface like a flat surface and having a greater longitudinal inclination angle than the front surface 112*a* of the projection lens 112. At this time, the front edge of each upright wall surface 112*c* is formed to linearly extend in the horizontal direction when viewed from the front side of the lamp. In addition, each upright wall surface 112*c* is formed to extend rearward from the front edge thereof by an inclination angle of 80° or more in relation to a plane perpendicular to the optical axis Ax. In addition, the maximum height h2 of each upright wall surface 112*c* is set to a value of ½ or more of the maximum thickness H2 of the projection lens 112.

The projection lens 112 is supported, at the outer circumferential flange 112*d* thereof, by the lens holder 120. The lens holder 20 is formed in an annular shape and supports the outer circumferential surface and the rear surface of the outer circumferential flange 112*d* of the projection lens 12. However, the inner circumferential surface 120*a* of the lens holder 20 is not formed with a flange corresponding to the inner circumferential flange 20*b* of the lens holder 20 of the exemplary embodiment.

A shade 118 of the present modification is formed in a flat plate shape and the upper surface of the shade 118 is configured as an upward reflective surface 118*a* subjected to a metal deposition processing. The upward reflective surface 118*a* has the same surface shape as the upward reflective surface 18*a* of the exemplary embodiment. In addition, the front edge 118*a*1 of the shade 118 has the same shape as the front edge 18*a*1 of the exemplary embodiment. The shade 118 is supported on a heat sink 122.

The front surface of the heat sink 122 is configured as an inclined surface that is downwardly inclined to extend forward. A shield piece 122*a* having an L-shape in a sectional side view is formed on the lower end of the heat sink 122 integrally with the heat sink 122.

The shield piece 122*a* is located below the optical axis Ax and horizontally extends forward from the heat sink 122 and then extends upward. A plurality of irregularities 122*s* is formed in a vertical stripe pattern on the front surface 122*a*1 of the shield piece 122*a*. At this time, the front surface 122*a*1 of the shield piece 122*a* is located in front of a middle point between the rear focal point F and the rear surface 112*b* of the projection lens 112 and the upper edge of the front surface 122*a*1 is located somewhat lower than the optical axis Ax.

In addition, an annular panel member 124 is located around the projection lens 112 to cover the outer circumferential flange 112*d* of the projection lens 112 and the lens holder 120 in an annular form from the front side.

As illustrated in FIG. 5, light, emitted from the light emitting device 14 and reflected by a region of the reflective surface 16*a* of the reflector 16 relatively close to the front edge, is directed toward the projection lens 112 by a relatively large downward angle.

At this time, assuming that the heat sink 122 is not formed with the shield piece 122*a*, as represented by a dot-dot-dashed line, some of reflected light from the reflector 16 is introduced to the projection lens 112 from a lower edge region of the rear surface 116*b* of the projection lens 112 and, thereafter, internally reflected by the upright wall surface 112*c* at the bottom of the projection lens 112 via total reflection. In addition, the light internally reflected by the upright wall surface 112*c* is irradiated, as uncontrolled stray light, forward from the front surface 112*a* of the projection lens 112 in the greatly upwardly deviated direction.

However, in the present modification, the heat shield 122*a* formed on the heat sink 122 is configured to shield the reflected light, which is reflected from the reflector 16 to be incident on the projection lens 112 from the lower edge region of the rear surface 112*b* of the projection lens 112, thereby preventing the reflected light from being internally reflected by the upright wall surface 112*c* at the lower side of the projection lens 112.

Meanwhile, the reflected light, which reaches the projection lens 112 without being shielded by the shield piece 122*a*, is incident on the projection lens 112 to be projected forward from the front surface 112*a* of the projection lens 112. At this time, even if some of the reflected light from reflected the reflector 16 and then internally reflected by the rear surface 112*b* of the projection lens 112*b* reaches the light shield piece 122*a*, the light is diffused and reflected in the transverse direction by the irregularities 122*s* formed on the front surface 122*a*1 of the light shield piece 122*a*. In this way, the reflected light is effectively suppressed from being incident again on the projection lens 12.

In the present modification, the light field piece 122*a*, which serves as a light control member integrally formed with the heat sink 122, may prevent the reflected light incident on the projection lens 112 from the reflector 16, from being internally reflected by the upright wall surface 112*c* at the lower side of the projection lens 112, thereby preventing generation of stray light that causes generation of light distribution unevenness.

In addition, in the present modification, due to the existence of the irregularities 112*s* formed on the front surface 122*a*1 of the light shield piece 122*a*, the reflected light reflected from the reflector 16 and surface-reflected by the rear surface 112*b* of the projection lens 112 may be diffused and reflected in the transverse direction. Therefore, the reflected light is effectively suppressed from being incident again on the projection lens 112.

In addition, in the exemplary embodiment and the modification thereof, numerical values described as data are merely given by way of example and, of course, may be properly set to different values.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A vehicle lamp comprising:

a projection lens; and a light source located behind the projection lens so that light emitted from the light source is irradiated forward through the projection lens, wherein the projection lens includes a sidewall surface which is smoothly curved to be a substantially flat surface having a longitudinally elongated shape when viewed from a front side thereof, a front edge of the sidewall surface is provided to linearly extend in a vertical direction when viewed from the front side of the projection lens, the sidewall surface has a greater inclination angle with reference to a plane perpendicular to an optical axis of the projection lens than a front surface of the projection lens when viewed in a horizontal cross section, and a light control member is provided on both left and right side portions of an inner circumferential surface of a lens holder supporting the projection lens to protrude closer to each other toward the optical axis behind the projection lens when viewed in a horizontal cross section such that light reflected in a direction away from the optical axis by a reflector is shielded by the light control member, thereby suppressing light incident toward the projection lens from the light source from being internally reflected by the sidewall surface toward the optical axis of the projection lens.

2. The vehicle lamp of claim 1, wherein the sidewall surface has a maximum thickness in a forward and backward direction of the projection lens that is set to a value of ½ or more of a maximum thickness of the projection lens in the forward and backward direction thereof.

3. The vehicle lamp of claim 1, wherein the light control member is configured by the lens holder.

4. The vehicle lamp of claim 2, wherein the light control member is configured by the lens holder.

5. The vehicle lamp of claim 1, wherein the light source is a light emitting device supported on a heat sink, and the light control member is configured by the heat sink.

6. The vehicle lamp of claim 2, wherein the light source is a light emitting device supported on a heat sink, and the light control member is configured by the heat sink.

7. The vehicle lamp of claim 1, further comprising:

a shade having an L-shape when viewed in a vertical cross section and configured to shield some of the light reflected from the reflector, wherein a front surface of the shade is formed with irregularities, and the reflector is configured to reflect light emitted from the light source toward the projection lens.

8. The vehicle lamp of claim 2, further comprising:

a shade having an L-shape when viewed in a vertical cross section and configured to shield some of the light reflected from the reflector, wherein a front surface of the shade is formed with irregularities, and the reflector is configured to reflect light emitted from the light source toward the projection lens.

9. The vehicle lamp of claim 3, further comprising:

a shade having an L-shape when viewed in a vertical cross section and configured to shield some of the light reflected from the reflector, wherein a front surface of the shade is formed with irregularities, the reflector is configured to reflect light emitted from the light source toward the projection lens.

10. The vehicle lamp of claim 4, further comprising:

a shade having an L-shape when viewed in a vertical cross section and configured to shield some of the light reflected from the reflector, wherein a front surface of the shade is formed with irregularities, and the reflector is configured to reflect light emitted from the light source toward the projection lens.

11. The vehicle lamp of claim 5, further comprising:

a shade having an L-shape when viewed in a vertical cross section and configured to shield some of the light reflected from the reflector, wherein a front surface of the shade is formed with irregularities, and the reflector is configured to reflect light emitted from the light source toward the projection lens.

12. The vehicle lamp of claim 6, further comprising:

a shade having an L-shape when viewed in a vertical cross section and configured to shield some of the light reflected from the reflector, wherein a front surface of the shade is formed with irregularities, and the reflector is configured to reflect light emitted from the light source toward the projection lens.

13. The vehicle lamp of claim 1, wherein the sidewall surface is configured to extend in a backward direction from the front edge thereof by the inclination angle equal to or larger than 80° with reference to the plane perpendicular to the optical axis of the projection lens.

14. The vehicle lamp of claim 1, wherein the light control member is provided such that a front surface thereof extends in a vertical direction along a rear surface of the projection lens.

15. The vehicle lamp of claim 1, wherein the sidewall surface includes a pair of upper and lower wall surfaces having a laterally elongated shape when viewed from the front side of the projection lens.

16. The vehicle lamp of claim 5, wherein a front surface of the heat sink is configured as a surface that is downwardly inclined to extend in a forward direction, and the light control member having an L-shape is provided at a lower end of the front surface of the heat sink when viewed in a vertical cross section.

17. The vehicle lamp of claim 6, wherein a front surface of the heat sink is configured as a surface that is downwardly inclined to extend in a forward direction, and the light control member having an L-shape is provided at a lower end of the front surface of the heat sink when viewed in a vertical cross section.

18. The vehicle lamp of claim 16, wherein a plurality of irregularities is provided on a front surface of the light control member in a vertical stripe pattern.

19. The vehicle lamp of claim 17, wherein a plurality of irregularities is provided on a front surface of the light control member in a vertical stripe pattern.

20. The vehicle lamp of claim 16, wherein a shade having a flat plate shape when viewed in a vertical cross section and configured to shield some of the light reflected from the reflector is provided on an upper surface of the heat sink.

* * * * *